US012006834B1

(12) United States Patent
Balla et al.

(10) Patent No.: US 12,006,834 B1
(45) Date of Patent: Jun. 11, 2024

(54) GAS TURBINE ENGINE HAVING A TIE ROD

(71) Applicant: General Electric Company, Schenectady, NY (US)

(72) Inventors: Ramesh Balla, Bangalore (IN); Bhaskar Nanda Mondal, Bengaluru (IN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 18/187,724

(22) Filed: Mar. 22, 2023

(30) Foreign Application Priority Data

Jan. 27, 2023 (IN) ..... 202311005474

(51) Int. Cl.
*F01D 5/02* (2006.01)
*F01D 5/03* (2006.01)

(52) U.S. Cl.
CPC ..... *F01D 5/03* (2013.01); *F01D 5/025* (2013.01)

(58) Field of Classification Search
CPC . F01D 5/025; F01D 5/026; F01D 5/03; F05D 2260/30; F05D 2260/31
See application file for complete search history.

(56) References Cited

U.S. PATENT DOCUMENTS 3,165,342 A * 1/1965 Anderson ..... F16D 1/08 403/374.2
4,247,256 A * 1/1981 Maghon ..... F01D 5/066 416/198 A

* cited by examiner

*Primary Examiner* — David E Sosnowski
*Assistant Examiner* — Jason G Davis
(74) *Attorney, Agent, or Firm* — McGarry Bair PC

(57) ABSTRACT

A gas turbine engine includes a plurality of annular discs arranged in an axial stack and defining axial passage, with at least one of the annular discs having an annular engagement member. A tie rod extends through the axial passage and secures the axial discs in the axial stack. The tie rod includes an annular collar defining an annular groove therein. The annular engagement member is received in the annular groove of the tie rod.

19 Claims, 5 Drawing Sheets

GAS TURBINE ENGINE HAVING A TIE ROD

BACKGROUND

Turbine engines, and particularly gas or combustion turbine engines, are rotary engines that extract energy from a flow of combusted gases passing through the engine onto a multitude of rotating turbine blades.

DETAILED DESCRIPTION

Figure 1:
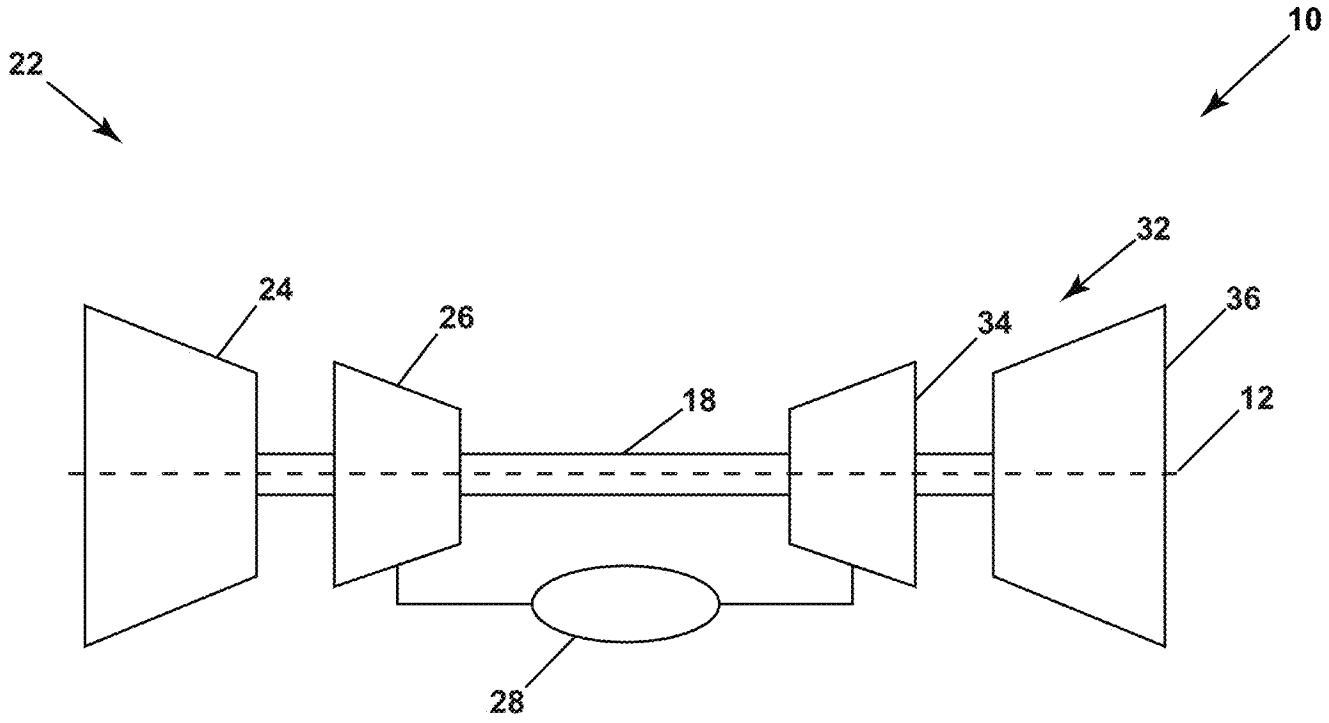
FIG. 1 is a schematic diagram of a gas turbine engine for an aircraft.

As used herein, the term "forward" or "upstream" refers to moving in a direction toward the engine inlet, or a component being relatively closer to the engine inlet as compared to another component. The term "aft" or "downstream" used in conjunction with "forward" or "upstream" refers to a direction toward the rear or outlet of the engine or being relatively closer to the engine outlet as compared to another component.

Additionally, as used herein, the terms "radial" or "radially" refer to a dimension extending between a center longitudinal axis of the engine and an outer engine circumference.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

In at least some known gas turbine engines, a high-pressure rotor assembly includes a plurality of compressor rotor discs and turbine rotor discs that are coaxially coupled together along the axis of rotation through a central tie rod that restricts axial movement therein. The tie rod extends through the inside diameter of the rotor components and is typically threadably secured at the compressor end of the rotor and extends into the turbine section. A threaded coupling can secure the turbine end of the tie rod and the stacked components are clamped when the threaded coupling is tightened.

During operation of the rotor assembly, the tie rod may vibrate at a frequency related to its unsupported length. With increasing demands for longer rotor assemblies, necessitating longer tie rods, this frequency of vibration may be lowered into the range of the engine operating frequencies, which can result in premature wear or damage.

Some prior solutions have employed a spring member disposed between at least one disc and the tie rod to provide resilient support and stiffen the tie rod during operation. However, in some cases, such springs can induce radially asymmetric loads that can result in rotor unbalance during operation. Other known solutions employed tie rods having thicker diameters to improve the diameter to length ratio of the tie rod. However, such solutions can increase the cost of fabrication, and have shown limited success in improving vibration mode margins. It would be desirable therefor to have a tie rod arrangement to enable improved vibration mode margins over conventional arrangements, without need for springs, or fasteners, and without need to increase the diameter of the tie rod. It would be further desirable to have a tie rod arrangement that facilitates ease of assembly in a gas turbine engine.

FIG. 1 is a schematic view of a turbine engine 10. As a non-limiting example, the turbine engine 10 can be used within an aircraft. The turbine engine 10 can include, at least, a compressor section 22, a combustion section 28, and a turbine section 32. A drive shaft 18 rotationally couples the compressor and turbine sections 22, 32, such that rotation of one affects the rotation of the other, and defines a rotational axis at an engine centerline 12 for the turbine engine 10.

The compressor section 22 can include a low-pressure (LP) compressor 24, and a high-pressure (HP) compressor 26 serially fluidly coupled to one another. The turbine section 32 can include an HP turbine 34, and an LP turbine 36 serially fluidly coupled to one another. The drive shaft 18 can operatively couple the LP compressor 24, the HP compressor 26, the HP turbine 34 and the LP turbine 36 together. As will be described in more detail herein, the drive shaft 18 can include an LP drive shaft (illustrated in FIG. 2) and an HP drive shaft (illustrated in FIG. 2). The LP drive shaft can couple the LP compressor 24 to the LP turbine 36, and the HP drive shaft can couple the HP compressor 26 to the HP turbine 34. An LP spool can be defined as the combination of the LP compressor 24, the LP turbine 36, and the LP drive shaft such that the rotation of the LP turbine 36 can apply a driving force to the LP drive shaft, which in turn can rotate the LP compressor 24. An HP spool can be defined as the combination of the HP compressor 26, the HP turbine 34, and the HP drive shaft such that the rotation of the HP turbine 34 can apply a driving force to the HP drive shaft which in turn can rotate the HP compressor 26.

The compressor section 22 can include a plurality of axially spaced stages. Each stage includes a set of circumferentially-spaced rotating blades and a set of circumferentially-spaced stationary vanes. The compressor blades for a stage of the compressor section 22 can be mounted to a disc or a blisk (a bladed disc), which is rotatably coupled to the drive shaft 18. Each set of blades for a given stage can have its own disc. The vanes of the compressor section 22 can be mounted to a casing which can extend circumferentially about the turbine engine 10. It will be appreciated that the representation in FIG. 1 of the compressor section 22 is merely schematic and that there can be any number of stages. Further, it is contemplated, that there can be any other number of components within the compressor section 22.

Similar to the compressor section 22, the turbine section 32 can include a plurality of axially spaced stages, with each stage having a set of circumferentially-spaced, rotating blades and a set of circumferentially-spaced, stationary vanes. The turbine blades for a stage of the turbine section 32 can be mounted to a disc which is mounted to the drive shaft 15. Each set of blades for a given stage can have its own disc. The vanes of the turbine section can be mounted to the casing in a circumferential manner. It is noted that there can be any number of blades, vanes and turbine stages as the turbine section illustrated in FIG. 1 is merely a schematic representation. Further, it is contemplated, that there can be any other number of components within the turbine section 32.

The combustion section 28 can be provided serially between the compressor section 22 and the turbine section 32. The combustion section 28 can be fluidly coupled to at least a portion of the compressor section 22 and the turbine section 32 such that the combustion section 28 at least partially fluidly couples the compressor section 22 to the turbine section 32. As a non-limiting example, the combustion section 28 can be fluidly coupled to the HP compressor 26 at an upstream end of the combustion section 28 and to the HP turbine 34 at a downstream end of the combustion section 28.

During operation of the turbine engine 10, ambient or atmospheric air is drawn into the compressor section 22 via a fan (not illustrated) upstream of the compressor section 22, where the air is compressed defining a pressurized air. The pressurized air can then flow into the combustion section 28 where the pressurized air is mixed with fuel and ignited, thereby generating combustion gases. Some work is extracted from these combustion gases by the HP turbine 34, which drives the HP compressor 26. The combustion gases are discharged into the LP turbine 36, which extracts additional work to drive the LP compressor 24, and the exhaust gas is ultimately discharged from the turbine engine 10 via an exhaust section (not illustrated) downstream of the turbine section 32. The driving of the LP turbine 36 drives the LP spool to rotate the fan (not illustrated) and the LP compressor 24. The pressurized airflow and the combustion gases can together define a working airflow that flows through the fan, compressor section 22, combustion section 28, and turbine section 32 of the turbine engine 10.

Figure 2:
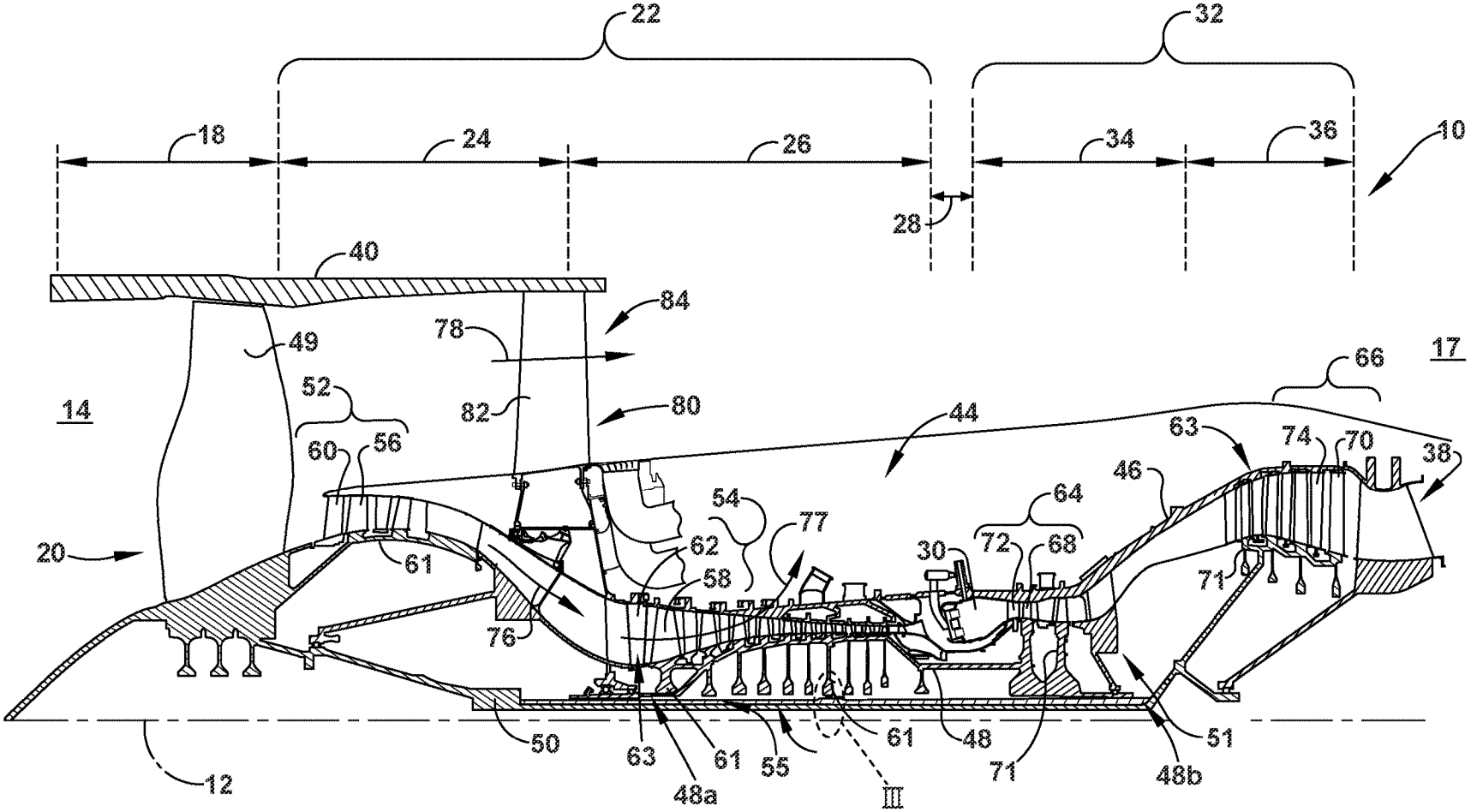
FIG. 2 is a cross-section view of a gas turbine engine in accordance with an aspect of the disclosure.

FIG. 2 is schematic cross-sectional diagram of the gas turbine engine 10 of FIG. 1. As illustrated, in aspects, the engine centerline 12 can extend forward 14 to aft 17, and define the axis of rotation. The engine 10 can also include a fan section 18 including a fan 20 upstream of the compressor section 22 and an exhaust section 38 downstream of the turbine section 32.

The fan section 18 can include an annular fan casing 40 surrounding the fan 20. The fan 20 includes a plurality of fan blades 49 disposed radially about the engine centerline 12. The HP compressor 26, the combustor 30, and the HP turbine 34 form a core 44 of the engine 10, which generates combustion gases. The engine core 44 is surrounded by an annular core casing 46, which can be coupled with the fan casing 40.

The LP compressor 24 and the HP compressor 26, respectively, include a plurality of compressor stages 52, 54, in which a set of compressor blades 56, 58 rotate relative to a corresponding set of static compressor vanes 60, 62 (also called a nozzle) to compress or pressurize the stream of fluid passing through the stage. In a single compressor stage 52, 54, multiple compressor blades 56, 58 can be provided in a ring and can extend radially outwardly relative to the engine centerline 12, from a blade platform to a blade tip, while the corresponding static compressor vanes 60, 62 are positioned upstream of and adjacent to the rotating compressor blades 56, 58. It is noted that the number of blades, vanes, and compressor stages shown in FIG. 2 were selected for illustrative purposes only, and that other numbers are possible.

An elongate annular HP shaft 48 disposed coaxially about the engine centerline 12 of the engine 10 drivingly couples the HP turbine 34 to the HP compressor 26. The HP shaft 48 can define a forward or compressor end 48*a*, and an opposing aft or turbine end 48*b*. An annular LP shaft 50 can be disposed coaxially about the engine centerline 12 and within the larger diameter annular HP shaft 48. The LP shaft 50 drivingly couples the LP turbine 36 to the LP compressor 24. The HP and LP shafts 48, 50 are rotatable about the engine centerline 12 and couple to a plurality of rotatable elements, which can collectively define a rotor 51.

The compressor section 22 can comprise a plurality of rotatable annular compressor discs 61. The compressor discs 61 can define a respective central aperture 65 therethrough. The plurality of compressor discs 61 are arranged in an axial stack defining an axial passage 55 therethrough. In an aspect, the central apertures 61 of the plurality of compressor discs 61 can be axially aligned to cooperatively define the axial passage 55. The axial passage 55 can have a forward or compressor end 55*a* and an aft or turbine end 55*b*. For example, when arranged in the axial stack, the central apertures 65 of the compressor discs 61 can cooperatively define at least a portion of the axial passage 55. In non-limiting aspects, the axial passage 55 can be concentric with the engine centerline 12. The HP and LP compressor blades 56, 58 for a stage of the compressor can be mounted to a respective compressor disc 61, which is rotatably coupled to the corresponding one of the HP and LP shafts 48, 50.

The HP turbine 34 and the LP turbine 36 respectively include a plurality of turbine stages 64, 66, in which a set of turbine blades 68, 70 are rotated relative to a corresponding set of static turbine vanes 72, 74 (also called a nozzle) to extract energy from the stream of fluid passing through the stage. In a single turbine stage 64, 66, multiple turbine blades 68, 70 can be provided in a ring and can extend radially outwardly relative to the engine centerline 12, from a blade platform to a blade tip, while the corresponding static turbine vanes 72, 74 are positioned upstream of and adjacent to the rotating turbine blades 68, 70. It is noted that the number of blades, vanes, and turbine stages shown in FIG. 2 were selected for illustrative purposes only, and that other numbers are possible.

The turbine section 32 can comprise a plurality of annular turbine discs 71. The turbine discs 71 can define a respective central aperture 65 therethrough. The plurality of compressor discs 61 are arranged in an axial stack defining an axial passage 55 therethrough. For example, when arranged in the axial stack, the central apertures 65 of the compressor discs 61 can cooperatively define the axial passage 55. In non-limiting aspects, the axial passage 55 can be concentric with the engine centerline 12. The turbine blades 68, 70 for a stage of the turbine can be mounted to a turbine disc 71, which is mounted to the corresponding one of the HP and LP shafts 48, 50, with each stage having a dedicated turbine disc 71. The vanes 72, 74 for a stage of the compressor can be mounted to the core casing 46 in a circumferential arrangement.

Complimentary to the rotor 51, the stationary portions of the engine 10, such as the static vanes 60, 62, 72, 74 among the compressor and turbine sections 22, 32 are also referred to individually or collectively as a stator 63. As such, the stator 63 can refer to the combination of non-rotating elements throughout the engine 10.

In operation, the airflow exiting the fan section 18 is split such that a portion of the airflow is channeled into the LP compressor 24, which then supplies pressurized airflow 76 to the HP compressor 26, which further pressurizes the air. The pressurized airflow 76 from the HP compressor 26 is mixed with fuel in the combustor 30 and ignited, thereby generating combustion gases. Some work is extracted from these gases by the HP turbine 34, which drives the HP compressor 26. The combustion gases are discharged into the LP turbine 36, which extracts additional work to drive the LP compressor 24, and the exhaust gas is ultimately discharged from the turbine engine 10 via the exhaust section 38. The driving of the LP turbine 36 drives the LP spool 50 to rotate the fan 20 and the LP compressor 24.

A portion of the pressurized airflow 76 can be drawn from the compressor section 22 as bleed air 77. The bleed air 77 can be drawn from the pressurized airflow 76 and provided to engine components requiring cooling. The temperature of pressurized airflow 76 entering and exiting the combustor 30 is significantly increased. As such, cooling provided by the bleed air 77 is supplied to downstream turbine components (e.g., a turbine blade 68) subjected to the heightened temperature environments.

A remaining portion of the airflow exiting the fan section, a bypass airflow 78 bypasses the LP compressor 24 and engine core 44 and exits the engine 10 through a stationary vane row, and more particularly an outlet guide vane assembly 80, comprising a plurality of airfoil guide vanes 82, at a fan exhaust side 84. More specifically, a circumferential row of radially-extending airfoil guide vanes 82 are utilized adjacent the fan section 18 to exert some directional control of the bypass airflow 78.

Some of the air supplied by the fan 20 can bypass the engine core 44 and be used for cooling of portions, especially hot portions, of the engine 10, and/or used to cool or power other aspects of the aircraft. In the context of a turbine engine, the hot portions of the engine are normally downstream of the combustor 30, especially the turbine section 32, with the HP turbine 34 being the hottest portion as it is directly downstream of the combustion section 28. Other sources of cooling fluid can be, but are not limited to, fluid discharged from the LP compressor 24 or the HP compressor 26.

An elongate tie rod 41 can be disposed in the axial passage 55. The tie rod 41 can be generally tubular and can be coaxial with the engine centerline 12. An annular collar 85 can be disposed on the tie rod. The tie rod 41 can define a first end 43 and an opposing second end 45. In some aspects, the tie rod 41 can extend between the forward or compressor end 48*a* and the aft or turbine end 48*b* of the HP shaft 48. For example, in non-limiting aspects, the first end 43 of the tie rod 41 can be threadably coupled to a compressor end 48*a* of the HP shaft 48, and the second end 45 of the tie rod 41 can be threadably coupled to the turbine end 48*b* of the HP shaft 48. In other aspects, the tie rod 41 can clamp or axially compressively retain the rotor 51 through any desired connection arrangement that enables the tie rod 41 to function as described herein.

Figure 3:
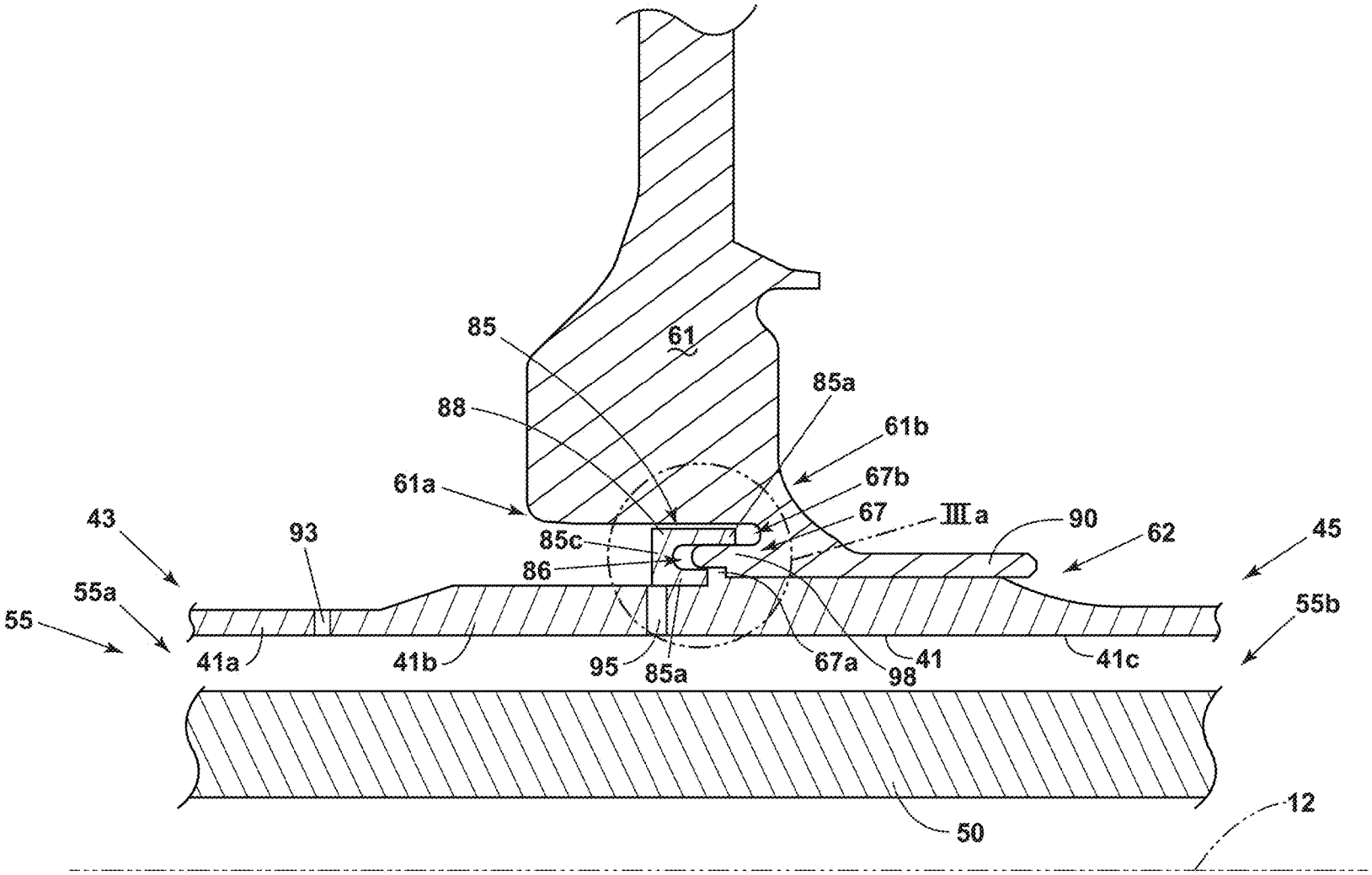
FIG. 3 depicts detail portion III of the cross-section view of the gas turbine engine of FIG. 2.
Figure 3A:
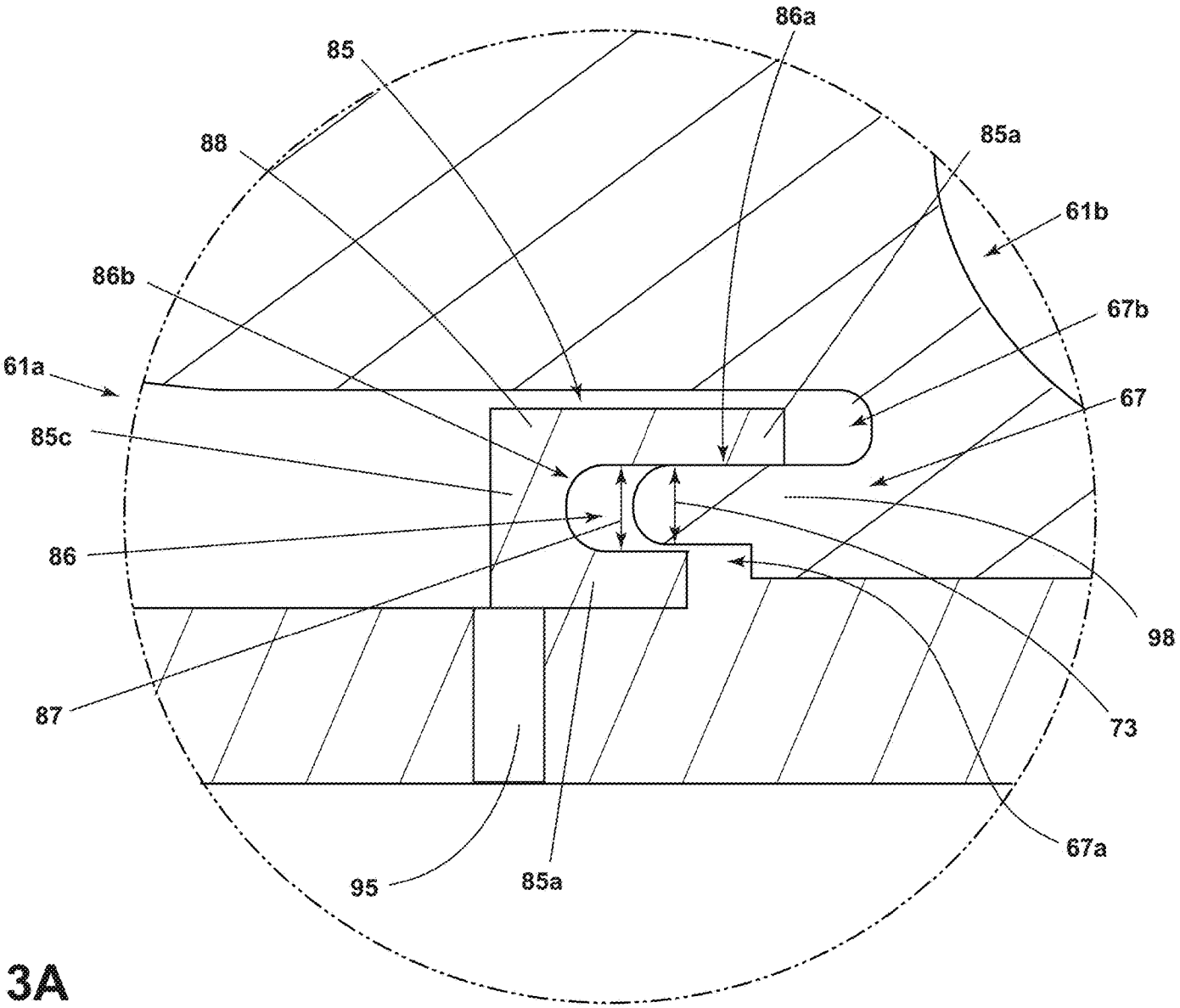
FIG. 3*a* depicts detail portion IIIa of FIG. 3.

FIG. 3 is a schematic cross-sectional diagram illustrating a detail portion III of FIG. 2, and FIG. 3*a* is a schematic cross-sectional diagram illustrating a detail portion Ma of FIG. 3. With simultaneous reference to FIGS. 3 and 3*a*, in some instances, the tie rod 41 can comprise multiple tie rod segments. For example, the tie rod 41 can include a first tie rod segment 41*a*, a second tie rod segment 41*b*, and a third tie rod segment 41*c*. The first and second tie rod segments 41*a*, 41*b* can be threadably coupled together at a first joint 93, and the second and third tie rod segments 41*b*, 41*c* can be threadably coupled at a second joint 95. In some aspects, at least one of the first and second joints 93, 95 can be disposed at the annular collar 85. In some non-limiting aspects, at least one of the first and second joints 93, 95 can be disposed forward of the annular collar 85. For example, at least one of the first and second joints 93, 95 can be disposed between the compressor end 55*a* of the axial passage 55 and the annular collar 85. It is contemplated that other aspects are not so limited, and the tie rod 41 can comprise any desired number of segments, including only one, without departing from the scope of the disclosure.

Figure 4:
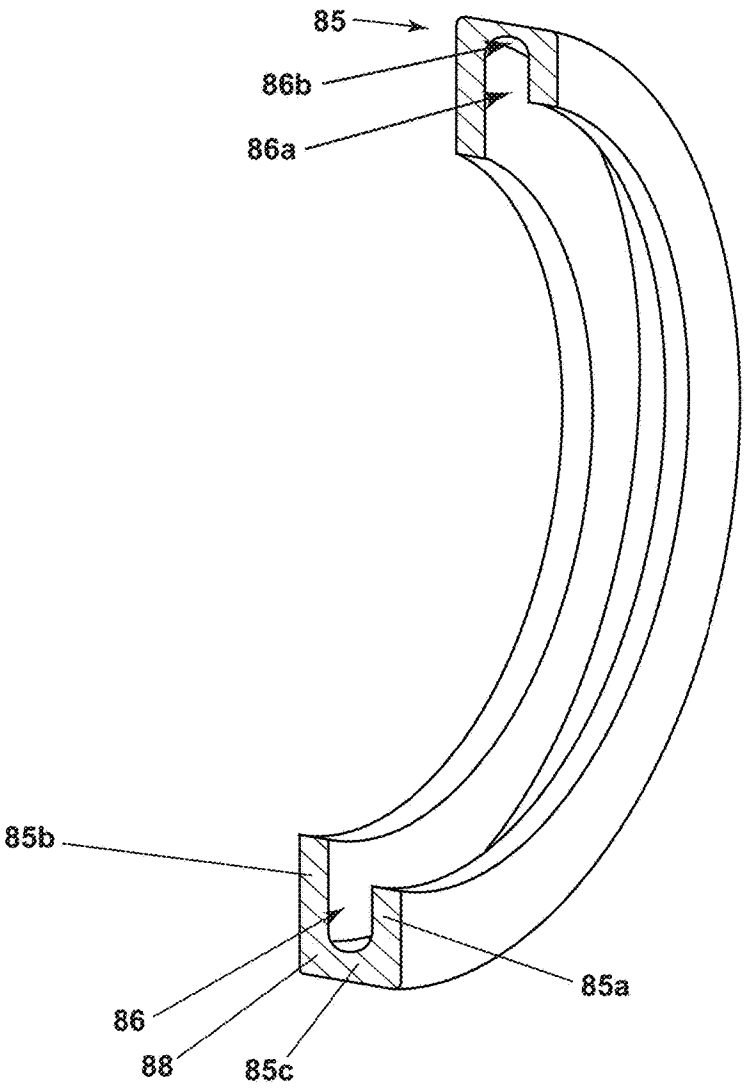
FIG. 4 depicts an isometric view in partial cross-section of an annular collar in accordance with an aspect of the disclosure.

The annular collar 85 can circumscribe the tie rod 41. The annular collar 85 can define a central aperture (not shown) sized to receive the tie rod 41 therethrough. The annular collar 85 can be coaxial with the engine centerline 12. In some aspects, the annular collar 85 can be formed as a continuous ring. In other non-limiting aspects, the annular collar 85 can be non-continuous. For example, in some aspects, the annular collar 85 can comprise a set of circumferentially-spaced collar segments 88. With reference to FIG. 4, an aspect of a collar segment 88 is illustrated. In non-limiting aspects, the collar segments 88 can be arranged to circumscribe the tie rod 41. In some aspects, the collar segments 88 can be coupled together to define the annular collar 85. In other aspects, the collar segments 88 can be circumferentially spaced from each other.

Referring again to FIGS. 3 and 3*a*, regardless of whether the annular collar 85 is continuous or non-continuous, the annular collar 85 can be fixedly coupled to the tie rod 41 to bear against a radially outer circumferential surface (e.g., a periphery) of the tie rod 41. the annular collar 85 can define an axially-extending annular groove 86 thereon. The annular groove 86 can have an open end 86*a* and a closed end 86*b*. The annular groove 86 can be axially aligned (e.g., in parallel) with the tie rod 41 and can define a radial height 87. For example, the annular collar 85 can comprise an axially-extending annular inner member 85*a* and an axially-extending annular outer member 85*b*. The annular collar 85 can further include a radially-extending bight member 87*c*. The bight member 87*c* can be disposed between and can couple the inner member 85*a* and the outer member 85*b*. The inner member 85*a* and outer member 85*b* can extend from the annular collar toward the compressor disc 61. The outer member 85*b* can be radially spaced from the inner member 85*a* by the radial height 87 to define the annular groove 86 therebetween. For example, as depicted in FIGS. 3, 3*a*, and 4, in some aspects, the annular collar 85 can have a C-shaped cross-section.

In non-limiting aspects, at least one compressor disc 61 can further include an axially-extending annular engagement member 67 extending therefrom. The engagement member can define a radial thickness 73. The engagement member 67 can be spaced from and axially aligned (e.g., in parallel) with the tie rod 41. The engagement member 67 can extend in axial alignment with the annular groove 86 and configured to operably engage the annular collar 85. The engagement member 67 can face the open end 86*a* of the annular groove 86. The annular groove 86 can be sized to receive the engagement member 67 therein. The engagement member 67 can be received in the annular groove 86 via a push or transition fit engagement. In some aspects, the radial height 87 of the annular groove 86 can be equal to or greater than the radial thickness 73 of the engagement member 67. For example, in some instances, a difference between the radial height 87 and the radial thickness 73 can define a clearance within a range of 0 to 0.010 inches. Other aspects are not so limited and the difference between the radial height 87 and the radial thickness 73 can be any desired dimension enabling an engagement therebetween without departing from the scope of the disclosure.

In some aspects, the annular engagement member 67 can be formed as a continuous ring. In other non-limiting aspects, the engagement member 67 can be non-continuous. For example, in non-limiting aspects, the engagement member 67 can comprise a set of circumferentially-spaced engagement segments 98. In some non-limiting aspects, the engagement segments 98 and the collar segments 88 can comprise multiple complementary, circumferential segments.

In non-limiting aspects, the at least one compressor disc 61 can additionally define an annular first recess 67*a* and an annular second recess 67*b*. The second recess 67*b* can be radially spaced from the first recess 67*a*. The engagement member 67 can be disposed between the first and second recess 67*a*, 67*b*. In some aspects, the first recess 67*a* can be defined between the engagement member 67 and the tie rod 41. The second recess 67*b* can be at least partially defined by the engagement member. The first recess 67*a* and second recess 67*b* can be axially aligned with the inner member 85*a* and the outer member 85*b*, respectively. For example, in some aspects, the first and second recess 67*a*, 67*b* can be sized to receive the inner member 85*a* and the outer member 85*b*, respectively, therein. The inner member 85*a* can be received in the first recess 67*a*, and the outer member 85*b* can be received in the second recess 67*b*, for example, via a push or transition fit engagement.

In non-limiting aspects, the at least one compressor disc 61 can additionally include a bearing member 90 extending therefrom. The bearing member 90 can be axially aligned with the tie rod 41 and arranged to bear against the tie rod 41.

The bearing member 90 and the engagement member can be disposed on opposite sides of the compressor disc 61. The bearing member 90 can extend from the compressor disc 61 in a direction opposing the engagement member 67. For example, in one aspect, the engagement member 67 can extend from a first side 61*a* (e.g., an upstream side) of the compressor disc 61, and the bearing member 90 can extend from a second side 61*b* (e.g., a downstream side) of the compressor disc 61. The engagement member 67 can extend from the compressor disc 61 toward the compressor section 22, while the bearing member 90 can extend from the compressor disc 61 toward the turbine section 32.

Aspects as described herein are adaptable to enable easier assembly of the gas turbine engine 10 than prior art techniques. For example, the various aspects do not require springs or fasteners such as bolts, as typically used in prior art arrangements to operative couple the tie rod 41 and compressor disc 61. Accordingly, aspects can be readily adaptable to provide for ease of assembly and disassembly during installation, maintenance, and repair operations. As will be described in more detail herein, the tie rod 41 can be configured to be installed during assembly of the gas turbine engine 10 by passing the tie rod 41 through the axial passage 55 optionally from either a compressor end 55*a*, or the turbine end 55*b*, as desired.

More specifically, in non-limiting aspects, the annular collar 85 can be formed integrally with the tie rod 41 to form a uniform or monolithic structure. In other aspects, prior to assembly in the gas turbine engine 10, the annular collar 85 can be fixedly coupled to the tie rod 41 via a weld or braze. Accordingly, during assembly of the turbine engine 10, the second end 45 of the tie rod 41 can be passed through the axial passage 55 from the compressor end 55*a*, and moved toward the turbine end 55*b* with the open end 86*a* of the annular groove 86 oriented to face the engagement member 67. As the tie rod 41 is advanced toward the turbine end 55*b*, the engagement member 67 can be received in the annular groove 86. Additionally, in some embodiments, the inner member 85*a* can be received in the first recess 67*a*, and the outer member 85*b* can be received in the second recess 67*b*. A torque or rotation can then be applied to the tie rod 41 to threadably couple the tie rod 41 to the HP shaft 48.

Conversely, in other aspects, the tie rod 41 can alternatively be configured to be installed during assembly of the gas turbine engine 10 by passing the tie rod 41 through the axial passage 55 from the turbine end 55*b*. For example, in non-limiting aspects, the annular collar 85 can be formed separately from the tie rod 41. The first end 43 of the tie rod 41 can be passed through the axial passage 55 from the turbine end 55*b* toward the compressor end 55*a*. Prior to threadably coupling the first end 43 of the tie rod 41 to the compressor end 48 of the HP shaft, the annular collar 85 can be inserted onto the first end 43 of the tie rod 41, with the open end 86*a* of the annular groove 86 oriented to face the engagement member 67. The annular collar 85 can be advanced along the tie rod 41 toward the at least one compressor disc 61 until the engagement member 67 is received in the annular groove 86. Additionally, in some embodiments, the inner member 85*a* can be received in the first recess 67*a*, and the outer member 85*b* can be received in the second recess 67*b*. A torque or rotation can then be applied to the tie rod 41 to threadably couple the tie rod 41 to the HP shaft 48.

Regardless of the direction of installation of the tie rod 41 and annular collar 85 during assembly of the gas turbine engine, Aspects as disclosed can further provide improved vibration damping of the tie rod 41 over prior art techniques. For example, due to the fixed engagement of the engagement member 67 in the annular groove 86 of the annular collar 85, a firm bracing of the tie rod 41 and compressor disc 61 can be arranged to dampen vibrations of the tie rod 41 during subsequent operation of the gas turbine engine 10. For example, aspects as described herein can reduce the radial asymmetric loading typically observed with a spring member disposed between at least one disc and the tie rod, or increasing the diameter of the tie rod, as in the prior art. Aspects as disclosed herein can induce a more radially-symmetric load on the tie rod can reduce problems such as rotor imbalance and tie rod vibration seen in prior art solutions.

This written description uses examples to describe aspects of the disclosure described herein, including the best mode, and also to enable any person skilled in the art to practice aspects of the disclosure, including making and using any devices or systems and performing any incorporated methods. The patentable scope of aspects of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The features disclosed in the foregoing description, in the following claims and/or in the accompanying drawings may, both separately and in any combination thereof, be material for realizing embodiments in diverse forms thereof. Various characteristics, aspects and advantages of the present disclosure may also be embodied in any permutation of aspects of the disclosure, including but not limited to the following technical solutions as defined in the enumerated aspects:

A gas turbine engine 10 comprising: a compressor section 22 and a turbine section 16 comprising a plurality of annular discs 61 arranged in an axial stack and defining axial passage 55, with at least one annular disc 61 having an annular engagement member 67; a tie rod 41 extending through the axial passage 55 and securing the discs 61 in the axial stack; and an annular collar 85 having an annular groove 86 receiving the annular engagement member 67.

The gas turbine engine 10 of the preceding clause, wherein the annular collar 85 is non-continuous.

The gas turbine engine 10 of any preceding clause, wherein the annular engagement member 67 is non-continuous.

The gas turbine engine 10 of any preceding clause wherein the annular collar 85 and annular engagement element 67 comprise multiple complementary, circumferential segments 88, 98.

The gas turbine engine 10 of any preceding clause, wherein the annular collar 85 circumscribes the tie rod 41.

The gas turbine engine 10 of any preceding clause, wherein the annular collar 85 is coupled to the tie rod 41 via an interference fit.

The gas turbine engine 10 of any preceding clause, wherein the annular collar 85 and tie rod 41 define a monolithic structure.

The gas turbine engine 10 of any preceding clause, wherein the annular collar 85 defines a C-shaped cross-section.

The gas turbine engine 10 of any preceding clause, wherein the annular collar 85 includes an annular radially inner member 85*a* and an annular radially outer member 85*b* radially spaced from the radially inner member 85*a* to define the annular groove 86 therebetween.

The gas turbine engine 10 of any preceding clause, wherein the radially inner member 85*a* and radially outer member 85*b* extend axially from the annular collar 85 toward the at least one annular disc 61.

The gas turbine engine 10 of any preceding clause, wherein the annular groove 86 includes an open end 86*a* disposed to face the engagement member 67.

The gas turbine engine 10 of any preceding clause, wherein the at least one annular disc 61 further defines an annular first recess 67*a* and an annular second recess 67*b* radially spaced from the first recess 67*a*.

The gas turbine engine 10 of any preceding clause, wherein the first recess 67*a* is defined between the engagement member 67 and the tie rod 41.

The gas turbine engine 10 of any preceding clause, wherein the second recess 67*b* is at least partially defined by the engagement member 67.

The gas turbine engine 10 of any preceding clause, wherein the first recess 67*a* is axially aligned with the radially inner member 85*a* and the second recess 67*b* is axially aligned with the radially outer member 85*b*.

The gas turbine engine 10 of any preceding clause, wherein the radially inner member 85*a* is received in the first recess 67*a*, and the radially outer member 85*b* is received in the second recess 67*b*.

The gas turbine engine 10 of any preceding clause, wherein at least one of the radially inner member 85*a* and the radially outer member 85*b* are respectively received in the first recess 67*a* and the second recess 67*b* via a transition fit.

The gas turbine engine 10 of any preceding clause, wherein the tie rod 41 includes a first end 43 disposed at the compressor section 22 and an opposing second end 45 disposed at the turbine section 16.

The gas turbine engine 10 of any preceding clause, wherein the tie rod 41 comprises at least two tie rod segments 41*a*, 41*b*, 41*c* coupled at a joint 93, 95.

The gas turbine engine 10 of any preceding clause, wherein the joint 93, 95 is disposed between a compressor end 55*a* of the axial passage and the annular collar 85.

A gas turbine engine 10 comprising: an annular disc 61 defining axial passage 55 therethrough, the annular disc 61 having an annular engagement member 67; a tie rod 41 extending through the axial passage 55 and securing the discs 61 in the axial stack; and an annular collar 85 having an annular groove 86 receiving the annular engagement member 67.

The gas turbine engine 10 of the preceding clause, wherein the annular collar 85 is non-continuous.

The gas turbine engine 10 of any preceding clause, wherein the annular engagement member 67 is non-continuous.

The gas turbine engine 10 of any preceding clause wherein the annular collar 85 and annular engagement element 67 comprise multiple complementary, circumferential segments 88, 98.

The gas turbine engine 10 of any preceding clause, wherein the annular collar 85 circumscribes the tie rod 41.

The gas turbine engine 10 of any preceding clause, wherein the annular collar 85 is coupled to the tie rod 41 via an interference fit.

The gas turbine engine 10 of any preceding clause, wherein the annular collar 85 and tie rod 41 define a monolithic structure.

The gas turbine engine 10 of any preceding clause, wherein the annular collar 85 defines a C-shaped cross-section.

The gas turbine engine 10 of any preceding clause, wherein the annular collar 85 includes an annular radially inner member 85*a* and an annular radially outer member 85*b* radially spaced from the radially inner member 85*a* to define the annular groove 86 therebetween.

The gas turbine engine 10 of any preceding clause, wherein the radially inner member 85*a* and radially outer member 85*b* extend axially from the annular collar 85 toward the at least one annular disc 61.

The gas turbine engine 10 of any preceding clause, wherein the annular groove 86 includes an open end 86*a* disposed to face the engagement member 67.

The gas turbine engine 10 of any preceding clause, wherein the at least one annular disc 61 further defines an annular first recess 67*a* and an annular second recess 67*b* radially spaced from the first recess 67*a*.

The gas turbine engine 10 of any preceding clause, wherein the first recess 67*a* is defined between the engagement member 67 and the tie rod 41.

The gas turbine engine 10 of any preceding clause, wherein the second recess 67*b* is at least partially defined by the engagement member 67.

The gas turbine engine 10 of any preceding clause, wherein the first recess 67*a* is axially aligned with the radially inner member 85*a* and the second recess 67*b* is axially aligned with the radially outer member 85*b*.

The gas turbine engine 10 of any preceding clause, wherein the radially inner member 85*a* is received in the first recess 67*a*, and the radially outer member 85*b* is received in the second recess 67*b*.

The gas turbine engine 10 of any preceding clause, wherein at least one of the radially inner member 85*a* and the radially outer member 85*b* are respectively received in the first recess 67*a* and the second recess 67*b* via a transition fit.

The gas turbine engine 10 of any preceding clause, wherein the tie rod 41 comprises at least two tie rod segments 41*a*, 41*b*, 41*c* coupled at a joint 93, 95.

The gas turbine engine 10 of any preceding clause, wherein the joint 93, 95 is disposed at the annular collar 85.

What is claimed is:

1. A gas turbine engine comprising:

a compressor section and a turbine section comprising a plurality of annular discs arranged in an axial stack and defining axial passage, with at least one annular disc of the plurality of annular discs having an annular engagement member;

a tie rod extending through the axial passage and securing the plurality of annular discs in the axial stack; and an annular collar having an annular groove receiving the annular engagement member, wherein the annular collar defines a C-shaped cross-section.

2. The gas turbine engine of claim 1, wherein the annular collar is non-continuous.

3. The gas turbine engine of claim 2, wherein the annular engagement member is non-continuous.

4. The gas turbine engine of claim 3 wherein the annular collar and the annular engagement member comprise multiple complementary, circumferential segments.

5. The gas turbine engine of claim 1, wherein the annular collar circumscribes the tie rod.

6. The gas turbine engine of claim 1, wherein the annular collar is coupled to the tie rod via an interference fit.

7. The gas turbine engine of claim 1, wherein the annular collar and tie rod define a monolithic structure.

8. The gas turbine engine of claim 1, wherein the tie rod includes a first end disposed at the compressor section and an opposing second end disposed at the turbine section.

9. The gas turbine engine of claim 1, wherein the tie rod comprises at least two tie rod segments coupled at a joint.

10. The gas turbine engine of claim 9, wherein the joint is disposed between a compressor end of the axial passage and the annular collar.

11. A gas turbine engine comprising:

a compressor section and a turbine section comprising a plurality of annular discs arranged in an axial stack and defining axial passage, with at least one annular disc of the plurality of annular discs having an annular engagement member;

a tie rod extending through the axial passage and securing the plurality of annular discs in the axial stack; and an annular collar having an annular groove receiving the annular engagement member, wherein the annular collar includes an annular radially inner member and an annular radially outer member radially spaced from the radially inner member to define the annular groove therebetween.

12. The gas turbine engine of claim 11, wherein the radially inner member and radially outer member extend axially from the annular collar toward the at least one annular disc.

13. The gas turbine engine of claim 11, wherein the annular groove includes an open end disposed to face the annular engagement member.

14. The gas turbine engine of claim 11, wherein the at least one annular disc further defines an annular first recess and an annular second recess radially spaced from the annular first recess.

15. The gas turbine engine of claim 14, wherein the annular first recess is defined between the annular engagement member and the tie rod.

16. The gas turbine engine of claim 14, wherein the annular second recess is at least partially defined by the annular engagement member.

17. The gas turbine engine of claim 14, wherein the annular first recess is axially aligned with the radially inner member and the annular second recess is axially aligned with the radially outer member.

18. The gas turbine engine of claim 14, wherein the radially inner member is received in the annular first recess, and the radially outer member is received in the annular second recess.

19. The gas turbine engine of claim 18, wherein at least one of the radially inner member and the radially outer member are respectively received in the annular first recess and the annular second recess via a transition fit.

* * * * *